US005980328A

United States Patent [19]

Takanashi et al.

[11] Patent Number: 5,980,328

[45] Date of Patent: Nov. 9, 1999

[54] CONNECTOR FOR USE WITH SUBSTRATES

[75] Inventors: Hitoshi Takanashi; Masaki Okamoto, both of Yokkaichi, Japan

[73] Assignee: Sumitomo Wiring Systems, Ltd., Japan

[21] Appl. No.: 08/920,454

[22] Filed: Aug. 29, 1997

[30] Foreign Application Priority Data

Sep. 4, 1996 [JP] Japan ..... 8-234439
Oct. 4, 1996 [JP] Japan ..... 8-264921

[51] Int. Cl.[6] ..... H01R 13/40

[52] U.S. Cl. ..... 439/733.1

[58] Field of Search ..... 439/733.1, 752.5, 439/682

[56] References Cited

U.S. PATENT DOCUMENTS 5,458,510 10/1995 Nager, Jr. et al. ..... 439/733.1
5,462,456 10/1995 Howell ..... 439/733.1
5,586,915 12/1996 Baker et al. ..... 439/733.1
5,800,213 9/1998 Regnier et al. ..... 439/733.1

FOREIGN PATENT DOCUMENTS 640497 5/1994 Japan .

*Primary Examiner*—Gary F. Paumen
*Attorney, Agent, or Firm*—Jordan B. Bierman; Bierman, Muserlian and Lucas

[57] ABSTRACT

A connector assembly for attachment to a substrate wherein an engagement element is on one of the housing and the terminal and a stabilizer, complementary thereto, is on the other, thereby restraining the terminal from movement in any direction perpendicular to the insertion direction. Alternatively, a restriction piece is attached to—or part of—the housing so that it retains the attachment end of the terminal within the housing until it is ready to be attached to the substrate. In this way, the opportunities for damage or distortion of the terminal are minimized.

5 Claims, 10 Drawing Sheets

CONNECTOR FOR USE WITH SUBSTRATES

This Application claims the benefit of the priorities of Japanese Applications 8-234439, filed Sep. 4, 1996 and 8-264921, filed Oct. 4, 1996.

The present Invention is directed to an improved connector, especially one to be used in conjunction with a substrate such as a circuit board.

BACKGROUND OF THE INVENTION

A prior art substrate connector is disclosed in Japanese OPI 3-11566. As shown in FIG. 20, connector 1 consists of housing 2 which contains cavity 3. Terminal 4 is located in cavity 3 and includes mating section 4A containing spring contact 7, adapted to mate with another connector (not shown) and attachment end 8 which projects out of housing 2 and through a hole in circuit board P. Between spring contact 7 and attachment end 8 is strip 5. Connector 1 is secured to circuit board P at soldering section 6 of attachment end 8. Strip 5 includes deformable bend 9 which, upon flexing, absorbs stress which may be applied to soldering section 6 when the other connector is inserted or removed. This prevents separation of the solder from circuit board P and/or attachment end 8.

This device suffers from certain important disadvantages. The end of terminal 4 which carries spring contact 7 is box shaped, while strip 5 is a thin band. Thus, when terminal 4 is inside cavity 3, there is substantial free space between strip 5 and the inner walls of cavity 3. This construction permits unwanted movement of attachment end 8 which can easily be deformed if an outside force is applied either while transporting the connector or mounting it. This instability also creates a problem in aligning attachment end 8 with the corresponding through hole in circuit board P. Moreover, the stabilizers which have been previously used engage only the inner wall of cavity 3. This restricts motion in the direction of the inner walls, but does not secure the terminal in the direction perpendicular thereto. Thus, even if such stabilizers are provided, satisfactory stability of attachment end 8 is not achieved.

Another typical prior art connector is shown in FIG. 21. Connector 1 comprises housing 2 which contains cavity 3. Terminal 4 is located therein and consists of mating section 4A, attachment section 4C, and flexible section 4B. Mating section 4A receives another terminal (not shown) and attachment section 4C extends out of housing 2 through hole H in circuit board P.

When connector 1 is attached to circuit board P, housing 2 is fixed on the circuit board by soldering attachment section 4C thereto. When a complementary terminal (not shown) is inserted into mating section 4A, this can cause the mating section to move somewhat toward attachment section 4C. Flexible section 4B is intended to absorb such forces and prevent the generation of excessive stress at attachment section 4C and the soldering section.

However, there is a serious practical problem with connectors of this type. Specifically, attachment section 4C projects outside housing 2 upon assembly thereof and before attachment to circuit board P. Thus, as connectors 1 are handled, other elements may come into contact with projecting attachment section 4C, thereby bending or otherwise distorting it. Such distorted attachment sections would render the connectors unacceptable for commercial use.

SUMMARY OF THE INVENTION

It is the purpose of the present Invention to overcome the foregoing problems inherent in conventional constructions.

The Invention finds particular application in electrical connectors which are to be attached to printed circuit boards; however, its use is not limited thereto.

The inventive connectors comprise a housing, having at least one cavity therein, and a first male or female terminal in the cavity. The terminal includes a mating section, which is intended for connection to a second terminal, and an attachment end, which is spaced apart from the mating section in a longitudinal direction. The attachment end can extend outside the rear of the housing through a mounting opening and is intended to be connected to the substrate, for example, by soldering. There is a strip extending between the mating section and the attachment end which may be affixed thereto or unitary therewith. The strip is longitudinally movable relative to the cavity.

There is an engaging element on the housing or the strip and a stabilizer on the other one. The stabilizer is engaged by the engaging element and, once this is accomplished, movement of the strip (and the attachment end in particular) is substantially prevented.

In a modification of the device, the engaging element can be a slot located in the housing. The stabilizer is suitably arranged so that, when the terminal is inserted into the rear of the cavity, the stabilizer enters the slot and the terminal is secured thereby.

In a further modification of the present Invention, the engaging element is a guide which is attached to an inner wall of the cavity and spaced apart inwardly therefrom. This leaves a gap between the inner wall and the guide. The strip is inserted into the gap and is secured thereby. It is also provided with a resilient section which is capable of flexing in the longitudinal direction, whereby the attachment end is urged out of the housing through the mounting opening.

When the terminal is inserted into the cavity, the resilient section is compressed, thereby shortening its length. This permits the stabilizer to move to a point between the mating section and the attachment end and allows the resilient section to urge the stabilizer into the gap. To facilitate assembly, the cavity may be provided with a sloped surface opposite the guide. This sloped surface angles radially inwardly in the insertion direction of the terminal and permits passage of the mating section into the cavity along a path spaced apart from the guide.

Insofar as the stabilizer is concerned, the shape thereof is not particularly critical. A number of variations can be used, so long as the engaging element is complementary thereto and it secures the terminal, thereby preventing movement in any direction transverse to the insertion direction.

In a further embodiment of the Invention, the strip is provided with a resilient section, and the engaging element is a restriction piece, mounted on the housing, and movable between an active position and a disabled position. In its active position, the restriction piece engages the strip and prevents the resilient section from moving the attachment end through the mounting opening to the outside of the housing. In the disabled position, the restriction piece is out of contact with the strip and it is free to move outside the housing, whereby the attachment end projects therefrom.

In a preferred form of the Invention, the retraction piece consists of a projection which engages the strip when the restriction piece is in the active position. There is also provided a disabling section which, when pressure is applied thereto, causes the restriction piece to move from the active position to the disabled position. It has been found particularly advantageous to provide the disabling section in such a manner that, when the connector is pressed against the substrate for attachment thereto, the substrate presses against the disabling section thereby moving the restriction piece to its disabled position. The attachment end of the terminal is then projected through both the mounting hole of the cavity and the through hole in the substrate. It can then be readily soldered in place.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
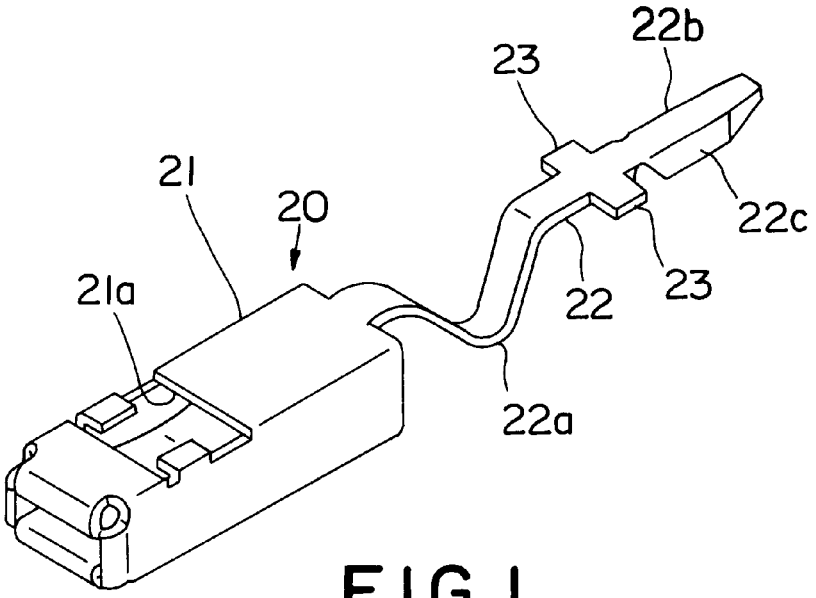
FIG. 1 is a perspective view of a terminal according to the present Invention.

Connector 10 comprises cavity 12 containing terminal 20. The terminal comprises mating section 21, strip 22, and attachment section 22*b*. Mating section 21 is provided with engagement opening 21*a* which is adapted to receive lance 13 upon complete insertion of terminal 20 into cavity 12.

Figure 2:
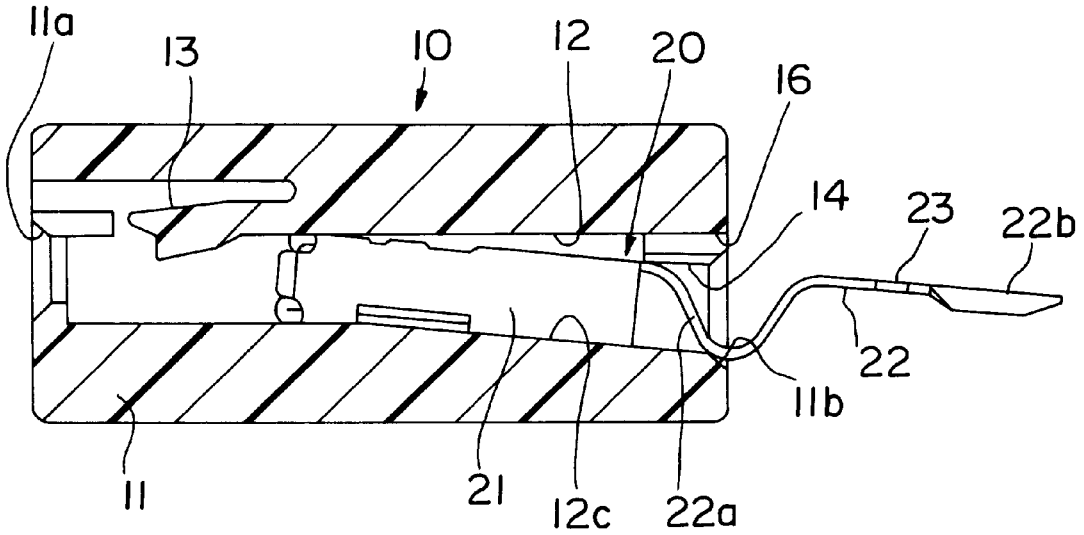
FIG. 2 is a side view, partly in section, showing the first step in the insertion of the terminal into the cavity.
Figure 3:
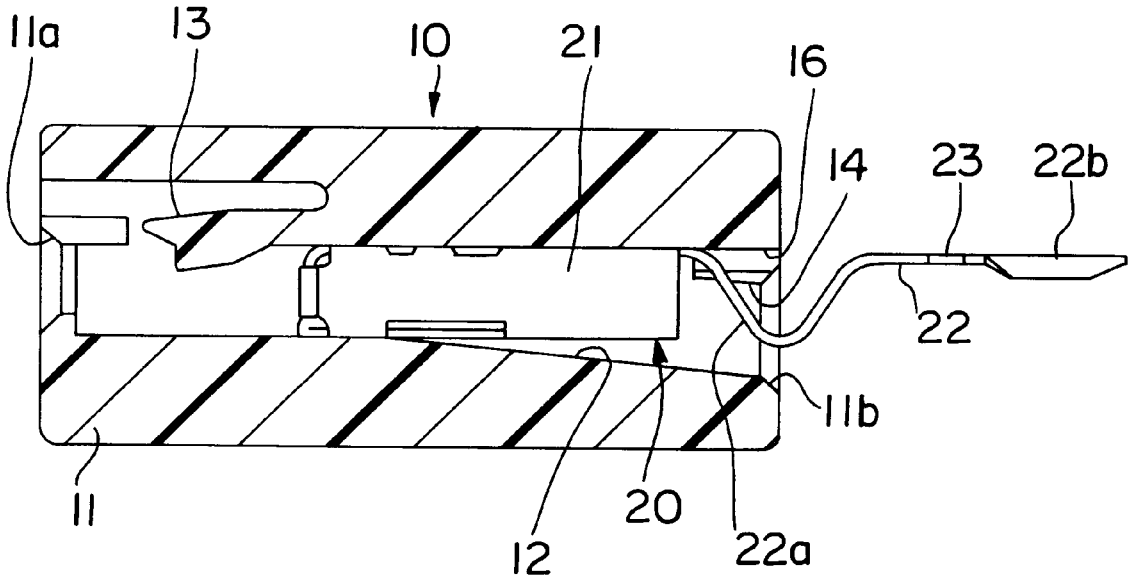
FIG. 3 is a view, similar to that of FIG. 2, wherein the terminal has cleared the guide.
Figure 4:
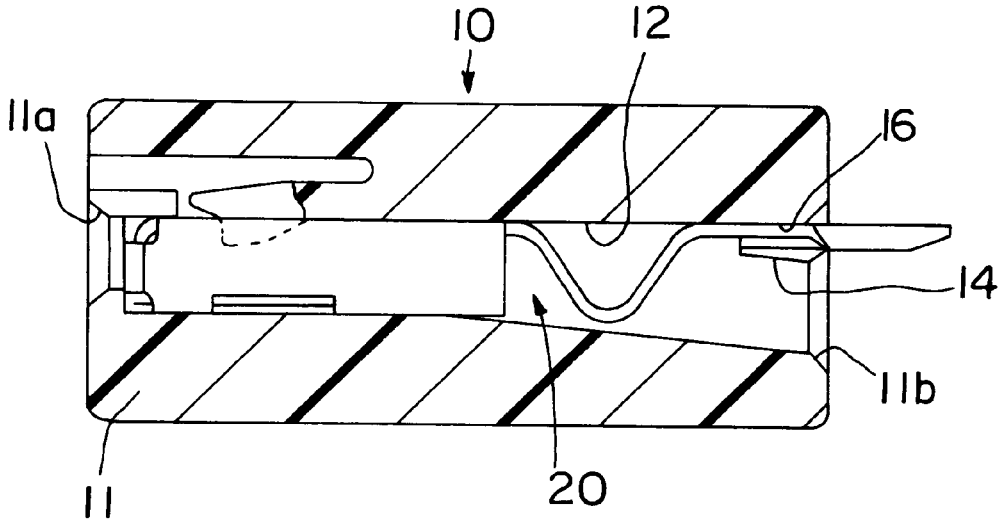
FIG. 4 is a view, similar to that of FIG. 3, with the terminal fully inserted into the housing.
Figure 5:
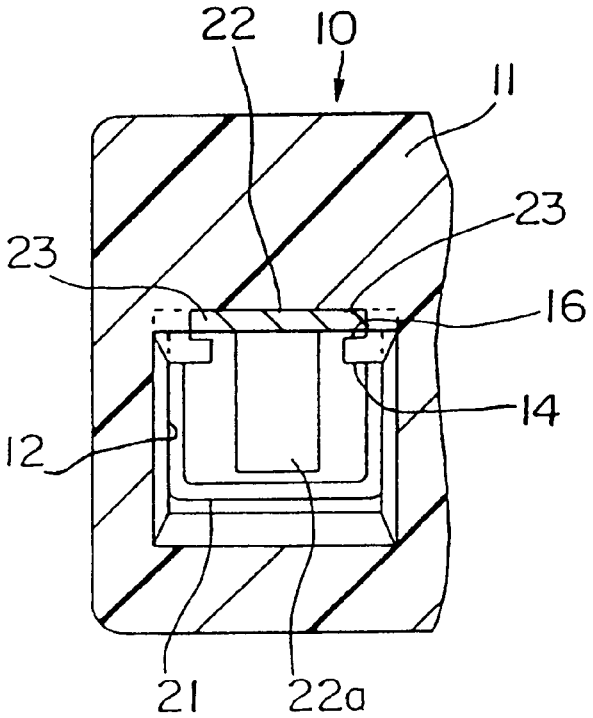
FIG. 5 is a cross-sectional view of FIG. 4 transverse to the insertion direction.

Strip 22 is provided with resilient section 22*a* located between stabilizers 23 and mating section 21. Attachment section 22*b* is box shaped having depending edges 22*c*. Cavity 12 is provided with insertion opening 11*a* and mounting opening 11*b*. Referring more specifically to FIGS. 2 to 4, terminal 20 is inserted through mounting opening 11*b*. Sloped surface 12C provides sufficient space so that mating section 21 can fit between guide 14 and the inner wall of the cavity. Once mating section 21 is passed guide 14, it is inserted fully into cavity 12 as shown in FIGS. 4 and 5. Stabilizers 23 are inserted into engagement groove 16, thereby securing the terminal in the cavity.

Figure 6:
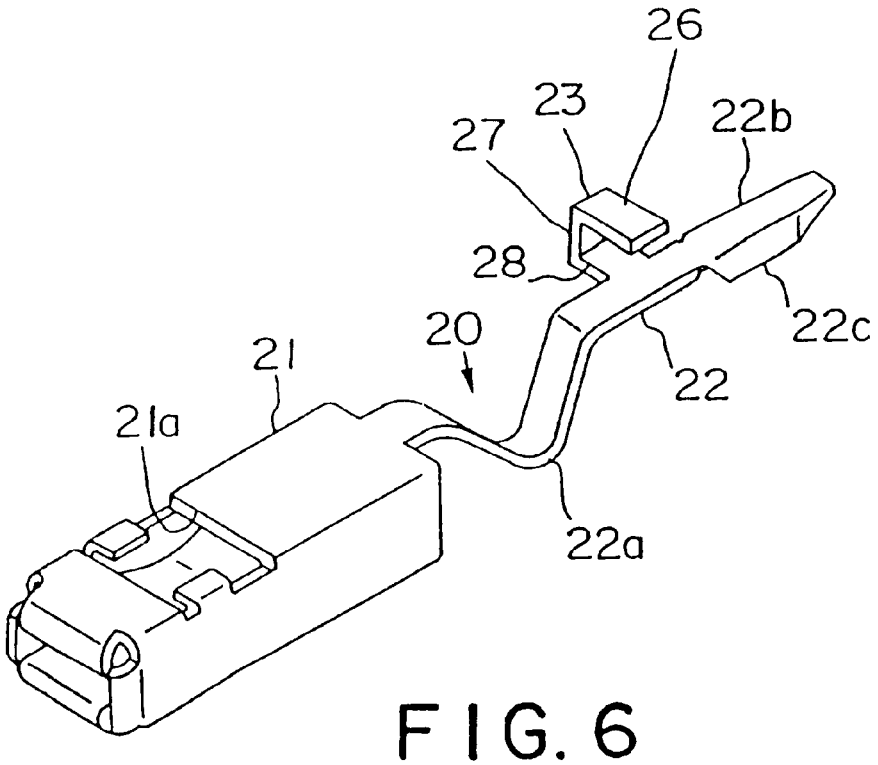
FIG. 6 is a perspective view, similar to that of FIG. 1, of a second embodiment of the present Invention.
Figure 7:
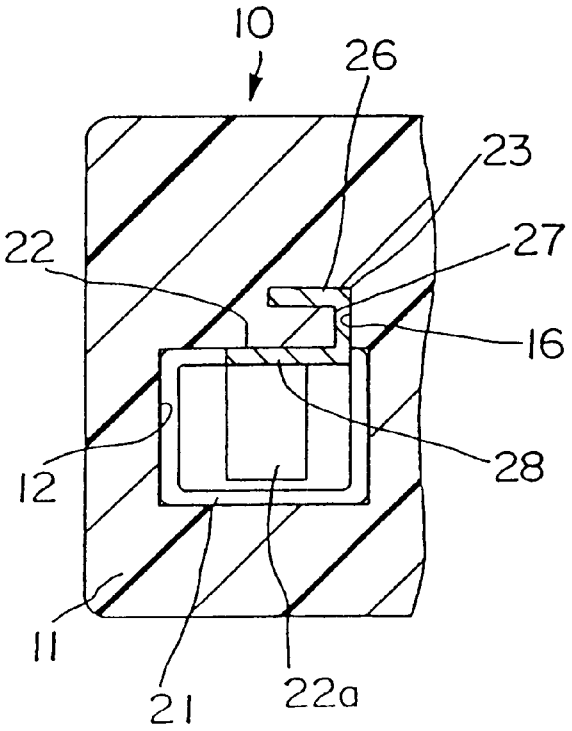
FIG. 7 is a view, similar to that of FIG. 5, of the embodiment of FIG. 6.
Figure 8:
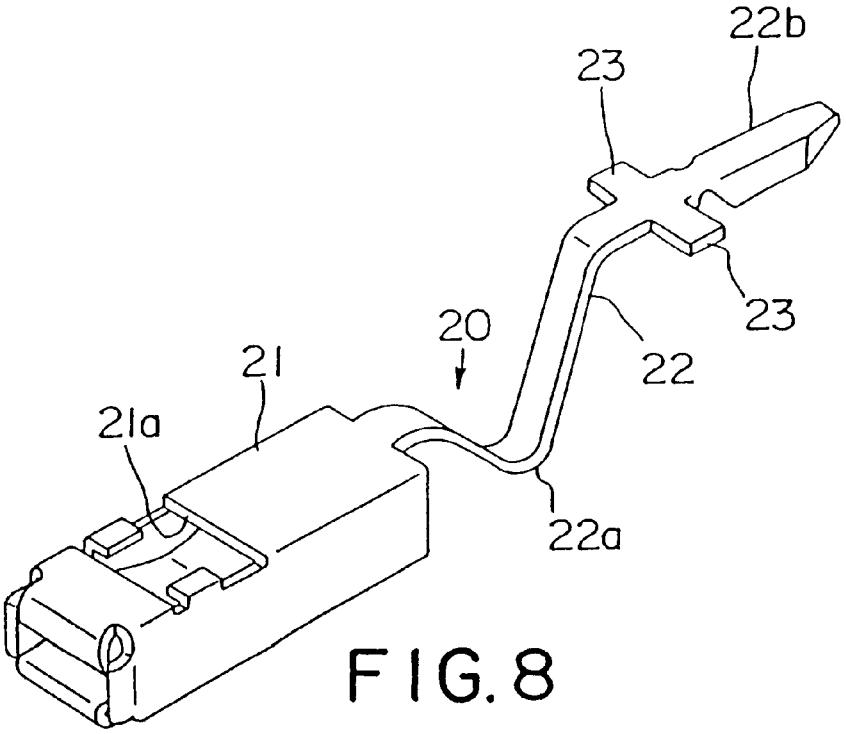
FIG. 8 is a perspective view, similar to that of FIG. 1, of a third embodiment of the present Invention.
Figure 9:
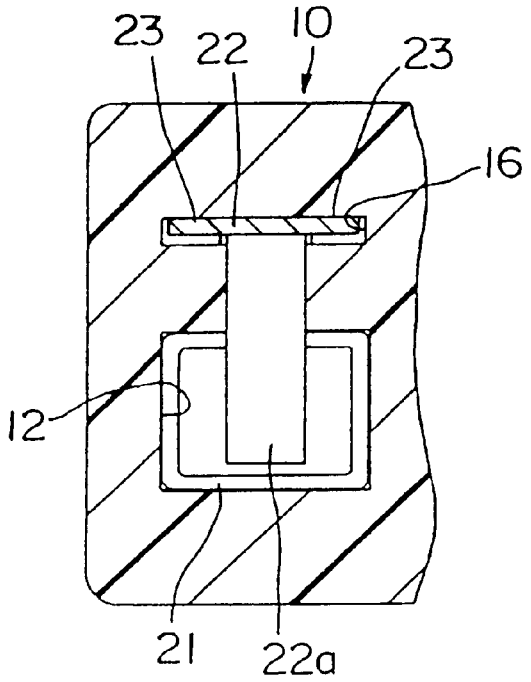
FIG. 9 is a view, similar to that of FIG. 5, of the embodiment of FIG. 8.
Figure 10:
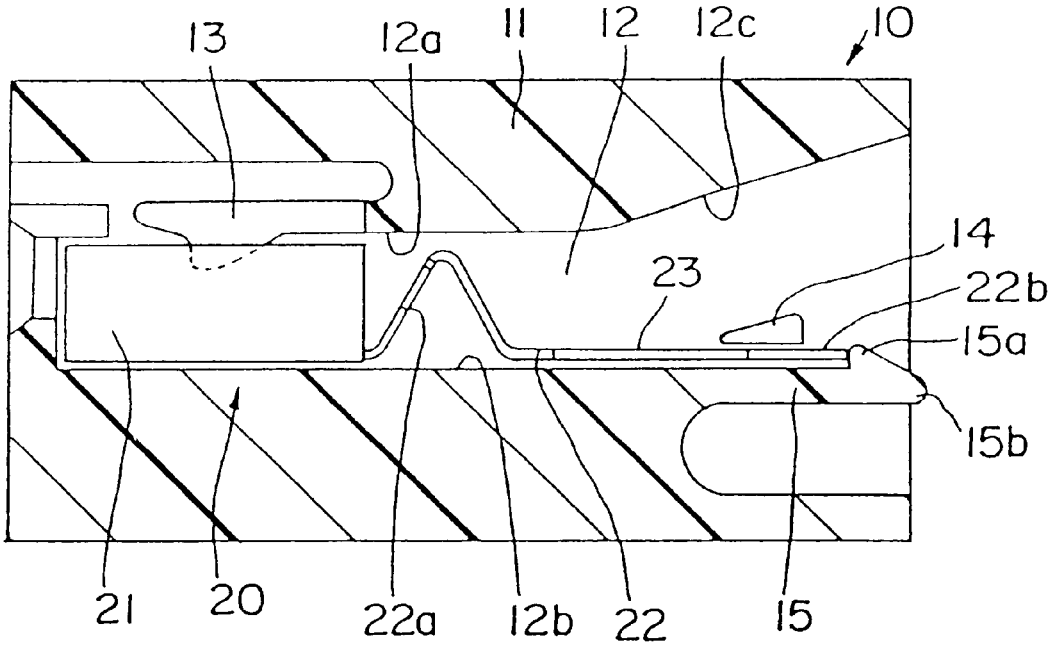
FIG. 10 is a view, similar to that of FIG. 4, of a fourth embodiment of the present Invention.
Figure 11:
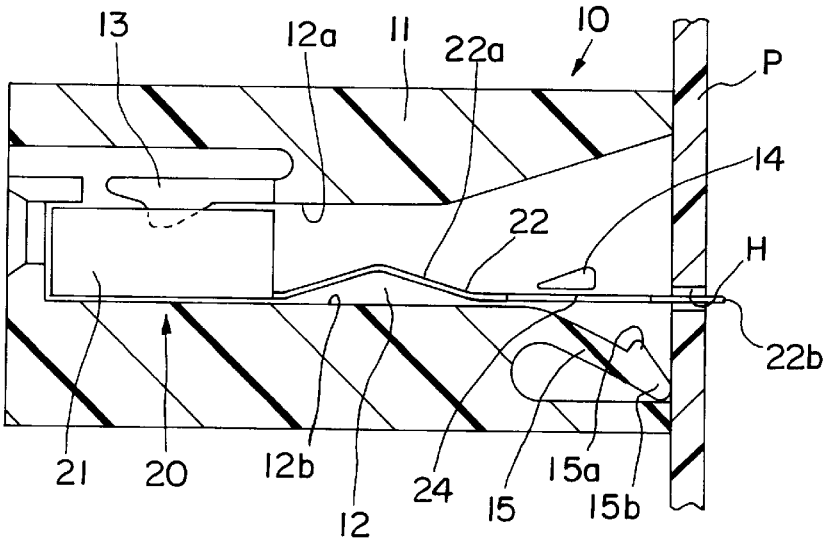
FIG. 11 is a view, similar to that of FIG. 10, with the connector positioned on the circuit substrate.
Figure 12:
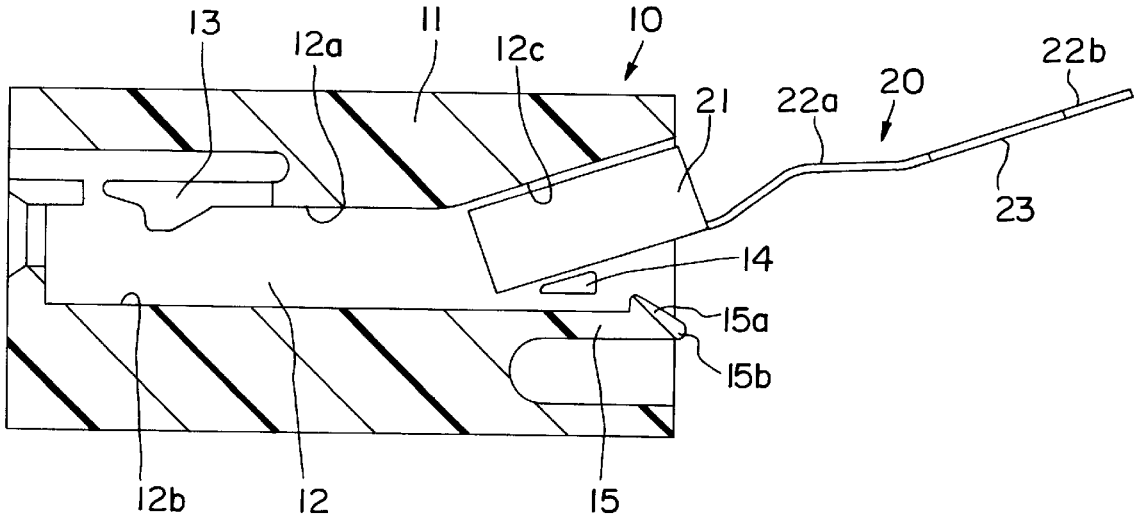
FIG. 12 is a view, similar to that of FIG. 2, of the fourth embodiment of the present Invention.

In FIGS. 6 and 7, a modification of the present Invention is shown. Stabilizer 23 consists of base 28, upstanding portion 27, and return 26. A still further modification is found in FIGS. 8 and 9. Strip 22 and resilient section 22*a* are so dimensioned as to locate stabilizer 23 in a plane above (as shown in FIGS. 8 and 9) mating section 21. Engagement groove 16 (see FIG. 9) is similarly located. In this form of the Invention, terminal 20 can be inserted into cavity 12 without the necessity of any flexing, bending, or sloped surfaces.

A further modification of the present Invention is shown in FIGS. 10 to 19. As most of the elements are the same as in previously-described forms of the Invention, explanation thereof need not be duplicated. Cavity 12 is provided with ceiling 12A and floor 12B. Sloped surface 12C assists in enabling mating section 21 to enter cavity 12 (see FIG. 12) and assume the position shown in FIG. 10. Resilient section 22*a* urges strip 22 to the right as shown in the Figures. Restriction piece 15 is attached—or integral with—housing 11 and includes projection 15A and disabling section 15B. Attachment section 22*b* is pressed against projection 15*a* by resilient section 22*a*. Guide 14 retains stabilizer 23 as in the other modifications. In a particularly preferred form of the Invention, substrate P, when placed against the end of housing 11, presses against disabling section 15B of restriction piece 15. This causes it to bend downward as shown in (for example) FIG. 11. In this position, it is out of contact with attachment section 22*b* of strip 22. Therefore, resilient section 22*a* presses attachment section 22*b* through the mounting opening and through hole H in substrate P. Advantageously, attachment section 22*b* will project beyond the remote face of substrate P, thereby facilitating soldering.

Figure 13:
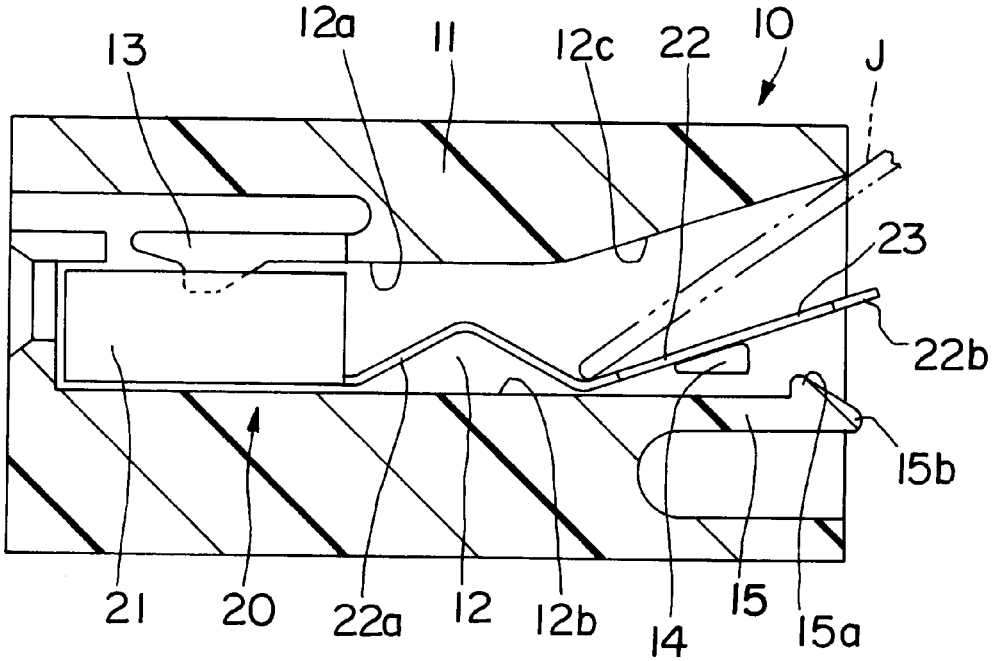
FIG. 13 is a view, similar to that of FIG. 11, showing the insertion of the terminal into the cavity.
Figure 14:
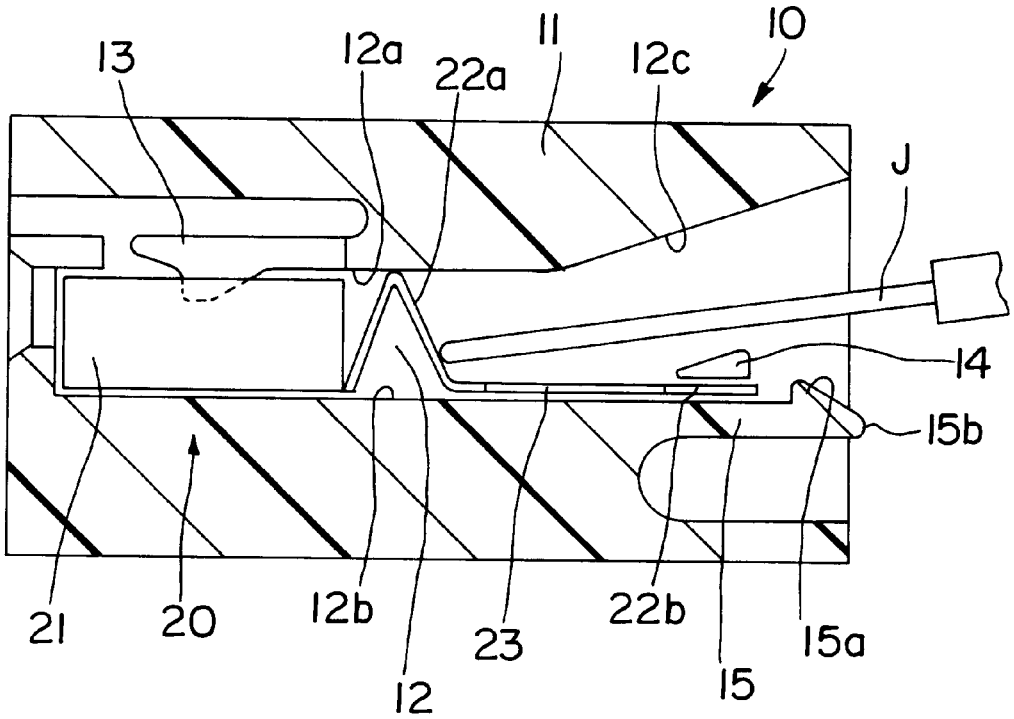
FIG. 14 is a view, similar to FIG. 13, with the terminal fully compressed.
Figure 15:
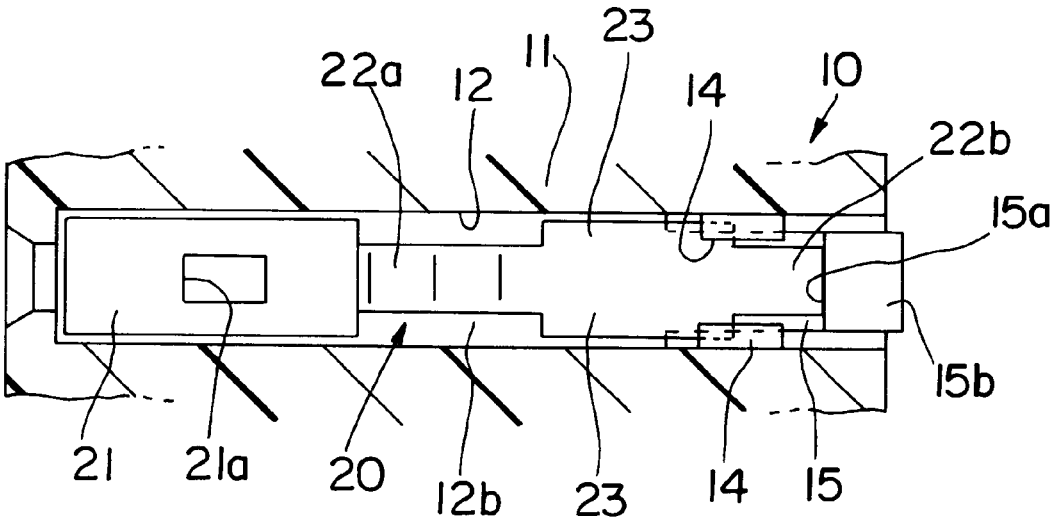
FIG. 15 is a plan view, partly in section, of the embodiment of FIG. 11.

As shown in FIGS. 13–15, after mating section 21 has been fully inserted into cavity 12, tool J is pressed against resilient section 22*a*. In this manner, strip 22 is moved to the left (as shown in FIG. 14) so that attachment end 22*b* clears guide 14. When tool J is released, resilient section 22*a* presses attachment end 22*b* between guide 14 and the adjacent inner wall of cavity 12. This movement continues until the leading edge of attachment end 22*b* contacts projection 15A.

Figure 16:
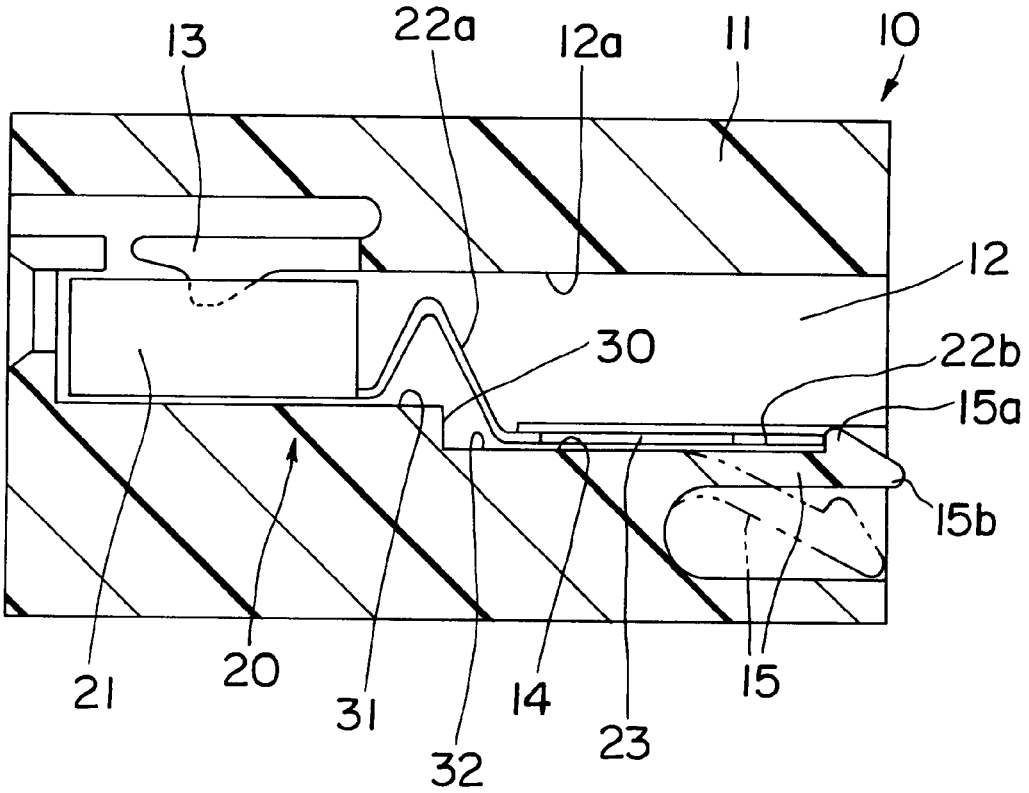
FIG. 16 is a view, similar to FIG. 14, of a fifth embodiment of the present Invention.
Figure 17:
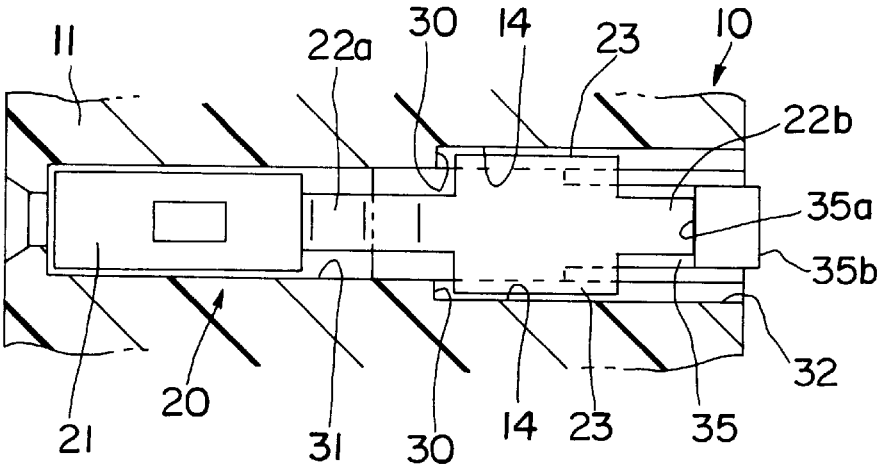
FIG. 17 is a view, similar to that of FIG. 15, of the embodiment of FIG. 16.
Figure 18:
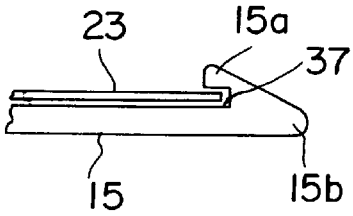
FIG. 18 is a fragmentary enlarged view showing a modification of the restriction piece.

Cavity 12, as shown in FIGS. 16 and 17, is provided with front floor 31 and rear floor 32. Since the distance between ceiling 12A and front floor 31 is less than the distance between rear floor 32 and ceiling 12A, shoulder 30 is formed at the junction thereof. This acts as a stop to prevent the tool (not shown in these Figures) from compressing resilient section 22*a* too far. Otherwise, the resilient section could be permanently distorted. It has been found advantageous, as shown in FIG. 18, to provide groove 37 on projection 15A of restriction piece 15. Stabilizer 23 is urged into groove 37 by the resilient section.

Figure 19:
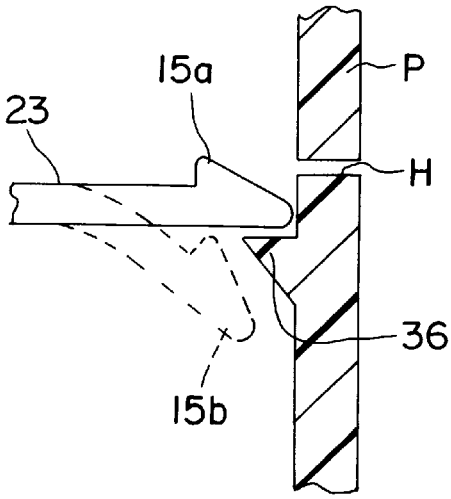
FIG. 19 is an enlarged fragmentary view, partly in section, showing the substrate disabling the restriction piece.
Figure 20:
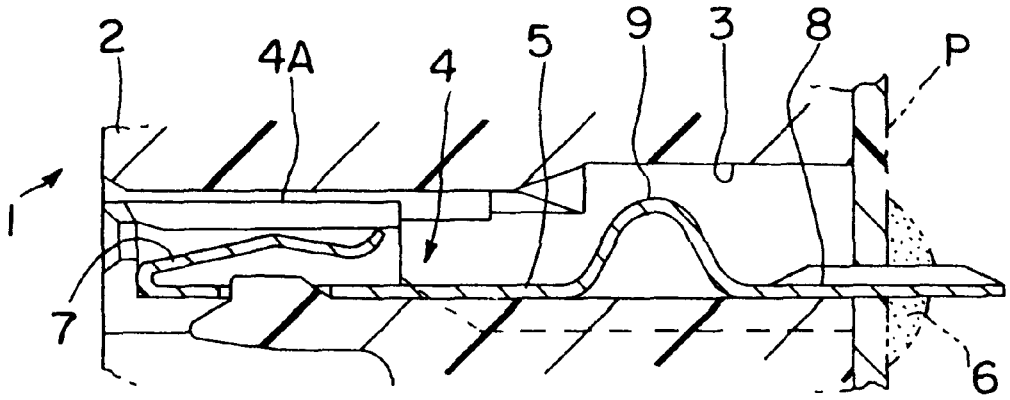
FIG.20 PRIOR ART
FIG. 20 is a prior art device.
Figure 21:
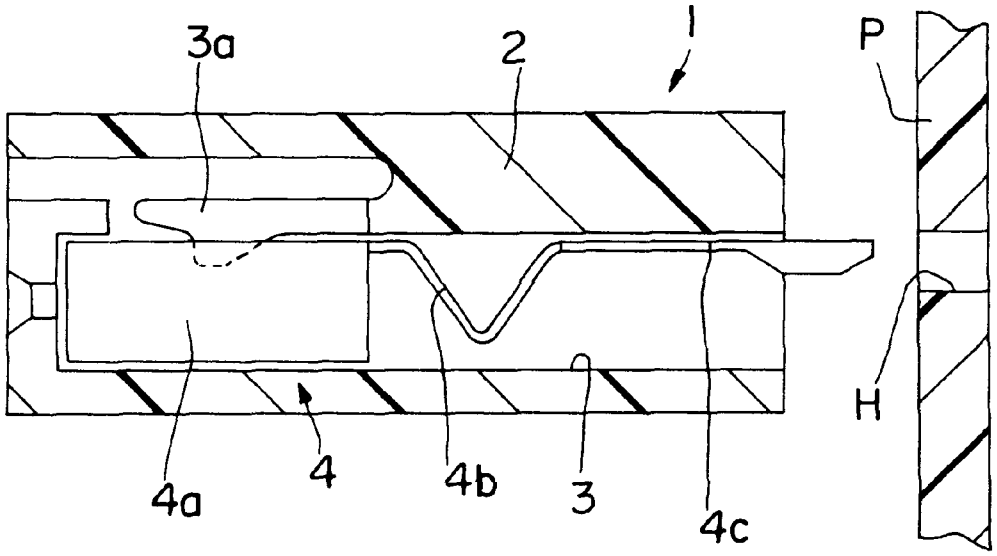
FIG.21 PRIOR ART
FIG. 21 is a further prior art device.

It has also been found useful to provide (as shown in FIG. 19) disabling actuator 36 on substrate P. Thus, as substrate P is placed against the connector, with through hole H properly aligned, pressure on the substrate causes restriction piece 15 to move into its disabled position as shown in phantom lines. Thus, the attachment end of the strip is released and urged by the resilient section through hole H. Since the attachment end is retained within the housing until it is actually inserted through hole H, there is no opportunity for damage or distortion during handling. Moreover, release of the attachment end is automatic when the substrate is pressed against the connector.

Although only a limited number of specific embodiments of the present Invention have been expressly disclosed, it is, nonetheless, to be broadly construed and not to be limited except by the character of the claims appended hereto.

What we claim is:

1. A connector assembly comprising a housing, having at least one cavity therein, and a first terminal in said cavity, said first terminal adapted for connection to a second terminal and comprising a mating section having a section width and an upper surface, an attachment section, spaced from said mating section in a longitudinal direction, said attachment section extending outside said housing through a mounting opening and adapted for connection to a substrate adjacent said mounting opening, a strip extending between said mating section and said attachment section and longitudinally movable relative to said cavity, a stabilizer on said strip and having a stabilizer width not exceeding said section width, said stabilizer being in a same horizontal plane as said upper surface, a pair of guides on said housing spaced apart inwardly from an inner wall of said cavity and spaced apart from each other, thereby forming a gap between said inner wall and said guide and there being a distance between said guides, said stabilizer being in said gap and said stabilizer width being greater than said distance, whereby movement of said attachment section perpendicular to said insertion direction is prevented;

said cavity having a first inner surface and, opposed thereto, a second inner surface, said first inner surface sloping toward said second inner surface in an insertion direction of said first terminal.

2. The connector assembly of claim 1 wherein said strip has a resilient section adapted to be compressed in said longitudinal direction away from said mounting opening, said resilient section, when compressed, urging said attachment end toward said mounting opening.

3. The connector assembly of claim 1 wherein said inner wall comprises a rear wall, adjacent said mounting opening, and a front wall remote from said mounting opening, said front wall being radially inward of said rear wall, thereby forming a shoulder between said front wall and said rear wall, said shoulder limiting movement of said strip in said longitudinal direction away from said mounting opening.

4. The connector assembly of claim 1 wherein said engaging element comprises a guide spaced apart inwardly from an inner wall of said cavity, thereby forming a gap between said inner wall and said guide, said strip having a resilient section capable of being compressed in said longitudinal direction away from said mounting opening as said first terminal is inserted into said cavity through said mounting opening, whereby said stabilizer moves to a point between said guide and said mating section, said resilient section urging said stabilizer toward said guide and into said gap.

5. The connector assembly of claim 2 wherein said cavity is provided with a radially inwardly sloped surface opposite said guide and adjacent said mounting opening, whereby said mating end and said stabilizer are inserted into said cavity along a path spaced apart from said guide.

* * * * *

UNITED STATES PATENT AND TRADEMARK OFFICE

CERTIFICATE OF CORRRECTION

PATENT NO. : 5,980,328
DATED : 11/9/99
INVENTOR(S) : Takanashi et al.

It is certified that error appears in the above-identified patent and that said Letters Patent is hereby corrected as shown below:

Title page, item [56] under

U. S. PATENT DOCUMENTS should read as following:

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 2 | 9 | 8 | 9 | 7 | 2 | 3 | 8/13/59 | Hopkins, et al | | | |
| | | 4 | 9 | 7 | 1 | 5 | 8 | 0 | 11/20/90 | Ward et al. | | | |
| | | 5 | 3 | 5 | 2 | 1 | 2 | 5 | 10/4/94 | Banakis, et al. | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 0 | 4 | 7 | 6 | 3 | 5 | 5 | 3/25/92 | EPO | | | | |

Other Documents

| |
|---|
| Patent Abstracts of Japan, Publication #03011566 Publication Date 18-01-91 |

Signed and Sealed this

Twenty-seventh Day of June, 2000

*Attest:*

Q. TODD DICKINSON

*Attesting Officer*

*Director of Patents and Trademarks*